US005619213A

United States Patent [19]

Hays, III

[11] Patent Number: 5,619,213

[45] Date of Patent: Apr. 8, 1997

[54] ANTENNA COUPLER FOR A PORTABLE RADIO

[76] Inventor: William W. Hays, III, 1255 Timber Lake Dr., Lynchburg, Va. 24502

[21] Appl. No.: 399,860

[22] Filed: Mar. 7, 1995

[51] Int. Cl.[6] ..... H01Q 1/24

[52] U.S. Cl. ..... 343/703; 343/702

[58] Field of Search ..... 343/703, 702, 343/841; H01Q 1/24

[56] References Cited

U.S. PATENT DOCUMENTS

| | | | |
|---|---|---|---|
| 3,286,264 | 11/1966 | Miley | 343/703 |
| 3,906,403 | 9/1975 | Czerwinski | 333/22 R |
| 4,134,119 | 1/1979 | Sandoz et al. | 343/703 |
| 4,220,955 | 9/1980 | Frye | 343/703 |
| 4,286,335 | 8/1981 | Eichler et al. | 455/89 |
| 5,278,571 | 1/1994 | Helfrick | 343/703 |

FOREIGN PATENT DOCUMENTS

| | | | |
|---|---|---|---|
| 2266997 | 11/1993 | United Kingdom | H01Q 1/32 |
| WO9507556 | 3/1995 | WIPO | H01Q 1/32 |

OTHER PUBLICATIONS

RF Industries, Ltd., vol. 1, A4102CLRPMS Jan. 25, 1994.

*Primary Examiner*—Michael C. Wimer
*Attorney, Agent, or Firm*—David G. Matthews; David C. Hall

[57] ABSTRACT

An antenna coupler for coupling a portable radio to an auxiliary antenna to provide transmission and reception through the auxiliary antenna. The antenna coupler includes an outer tubular conductor and an inner tubular conductor coaxially disposed within the outer tubular conductor. An end cover having an antenna opening is secured to one end of the tubular conductors. The radio and auxiliary antenna are placed in a coupled position by inserting the on-board antenna into the inner tubular conductor. The coupled, on-board antenna and inner tubular conductor form a close-coupled transmission line with the antenna functioning as the central conductor and the inner tubular conductor functioning as an outer conductor of the transmission line. The inner tubular conductor is conductively connected to an impedance matching circuit and RF connector for providing impedance matching and interconnection with the auxiliary antenna. In addition, the outer tubular conductor is grounded to the radio collar to provide a common ground, and functions as the outer ground or shield for the close-coupled transmission line.

23 Claims, 7 Drawing Sheets

ANTENNA COUPLER FOR A PORTABLE RADIO

FIELD OF THE INVENTION

The present invention relates generally to antenna couplers for portable radios, and more particularly to coupling an on-board antenna of a portable radio to an auxiliary antenna.

BACKGROUND OF THE INVENTION

Handheld, portable radios are designed to be small and compact to allow users conveniently to carry and use the portable radios. Due to size and other design considerations, the on-board antennas for portable radios often provide only marginal transmission characteristics and radiated signal strength. The transmission characteristics of a portable radio are also substantially diminished when the portable radio is used in a vehicle. To overcome the poor transmission characteristics of a portable radio operating in a vehicle, the portable radio can be coupled to a vehicle or auxiliary antenna which has improved transmission characteristics. By coupling a portable radio to a more effective auxiliary antenna, the radiated signal strength of the portable radio can be substantially improved.

In the past, portable radios have been coupled to auxiliary antennas in various different ways. For example, a portable radio can be provided with a dedicated, auxiliary-antenna connector and switch on the portable radio for providing connection to the auxiliary antenna. The auxiliary-antenna connector connects with a mating connector leading to the auxiliary antenna, and the switch functions to switch between the on-board antenna and the auxiliary-antenna connector. The problem with this type of coupling is that additional hardware and space are required in the radio for the auxiliary-antenna connector and switch.

U.S. Pat. No. 4,220,955, issued to Frye, on Sep. 2, 1980, discloses another coupling arrangement between a portable radio and auxiliary antenna. Disclosed is an antenna coupler having a helical coil that couples a helical, on-board antenna on a portable radio to an auxiliary antenna using inductive coupling. The antenna coupler of U.S. Pat. No. 4,220,955 provides a relatively complicated antenna coupler where the helical coil in the antenna coupler has a length, diameter, and number of turns based on the operating frequency of the portable radio.

SUMMARY OF THE INVENTION

The invention provides an improved antenna coupler that allows a portable radio to be coupled to an auxiliary antenna to provide transmission and reception through the auxiliary antenna. The antenna coupler eliminates the need for the radio to be provided with expensive, additional hardware in order to be compatible with the antenna coupler. In addition, the antenna coupler is designed to operate with different types of on-board antennas and over different radio frequency ranges with out requiring significant design changes to the antenna coupler.

The antenna coupler includes an outer tubular conductor and an inner tubular conductor coaxially disposed within the outer tubular conductor. The inner and outer tubular conductors are elongated cylinders extending from an insertion end to a remote end. An end cover is secured to the insertion end and has an antenna opening for allowing insertion of the on-board antenna of the portable radio into the inner tubular conductor. The end cover at the insertion end further includes a ground connector for connecting the outer tubular conductor to a radio ground collar, and an impedance matching circuit and RF connector for connecting the inner tubular conductor to an interconnecting transmission line leading to the auxiliary antenna.

The radio and auxiliary antenna are placed in a coupled position by inserting the on-board antenna into the inner tubular conductor. The coupled, on-board antenna and inner tubular conductor form a close-coupled transmission line with the on-board antenna functioning as the central conductor and the inner tubular conductor functioning as an outer conductor of the transmission line. In addition, the outer tubular conductor is grounded to the radio collar to provide a common ground, and functions as an outer ground or shield for the on-board antenna and inner tubular conductor.

When in the coupled position, RF signals pass between the portable radio and the auxiliary antenna over the transmission line formed by the on-board antenna and tubular conductors. The impedance matching circuit provides impedance matching for the antenna and different impedance matching circuits can easily be provided for radios operating over different frequency ranges. The antenna coupler allows RF signals to be both transmitted and received via the auxiliary antenna.

Accordingly, it is an object of the present invention to provide an antenna coupler for coupling a portable radio to an auxiliary antenna.

Another object of the present invention is to provide an antenna coupler coupling a portable radio to an auxiliary antenna without requiring the radio to be modified with expensive, additional components.

Another object of the present invention is to provide an antenna coupler that is operational with different types of antennas and over varying frequency ranges without requiring significant design changes to the antenna coupler.

Another object of the present invention is to provide a common ground between an antenna coupler and portable radio without requiring significant modifications to the portable radio.

Another object of the present invention is to provide a compact antenna coupler.

Another object of the present invention is to provide an antenna coupler providing for impedance matching that can be optimized for different radio frequency ranges without significant modification of the antenna coupler.

These and other objects of the invention, together with features and advantages therefore, will become apparent from the following detailed specification when read with the accompanying drawings in which like reference numerals refer to like elements.

DETAILED DESCRIPTION OF THE PREFERRED EMBODIMENTS

Figure 1:
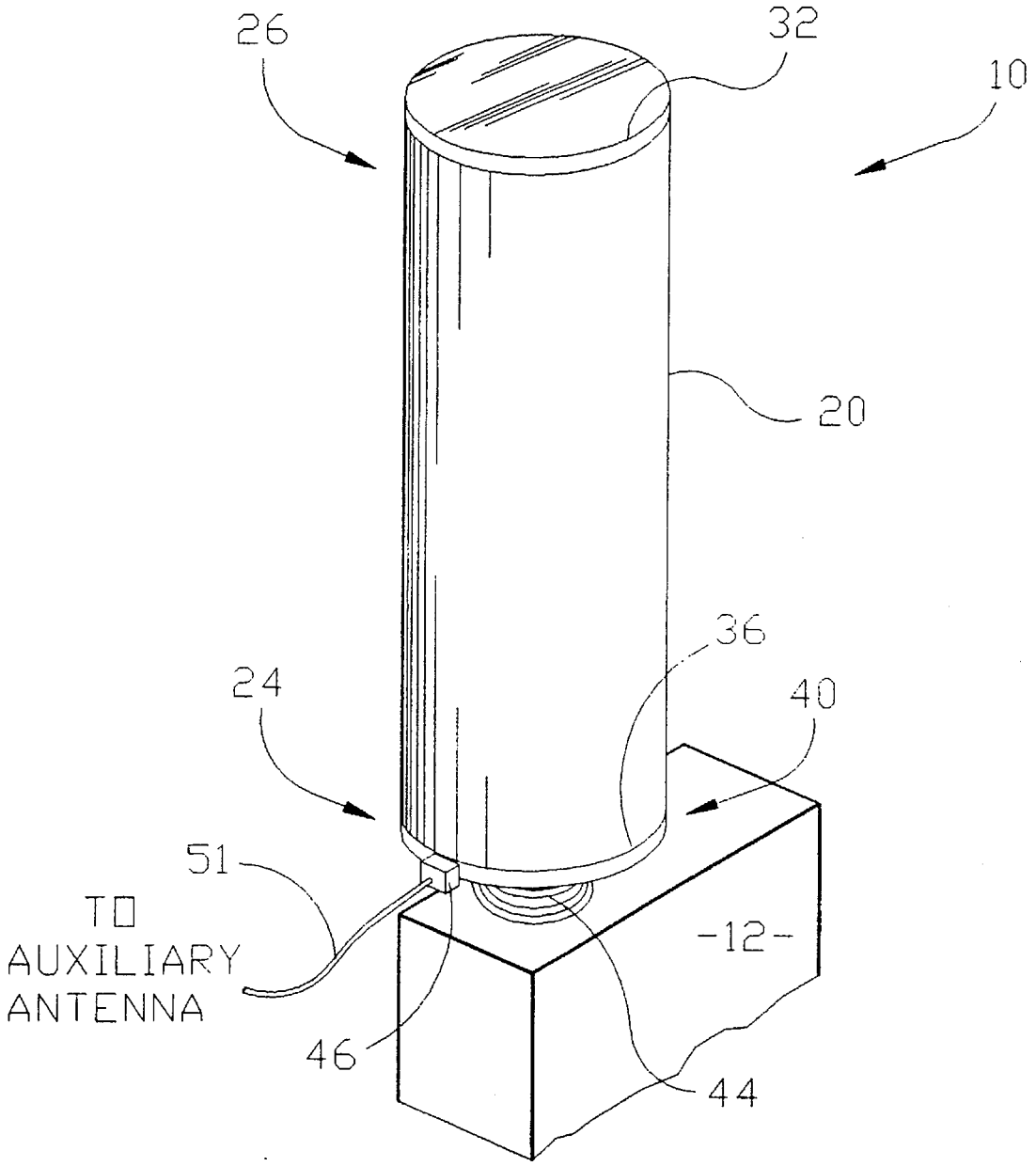
FIG. 1 is a perspective view of the antenna coupler of the present invention, shown with the onboard antenna of a portable radio being inserted into the antenna coupler.

Referring now to the drawings, the antenna coupler of the present invention is shown therein and indicated generally by the numeral 10. Antenna coupler 10 couples a portable radio 12 having an on-board antenna 14 to an auxiliary antenna 16 to provide improved transmission characteristics for the portable radio 12. The antenna coupler 10 is particularly designed for use in a vehicle to couple a portable radio 12 to the vehicular or auxiliary antenna 16. Other applications for antenna coupler 10 include performing quantitative and functional measurements on a portable radio 12 such as would be required in production quality testing. The antenna coupler 10 will be described as coupling on-board antenna 14 to an auxiliary antenna 16. It should be understood that antenna coupler 10 can also be coupled to other use or test RF devices such as signal generators and power meters.

Figure 2:
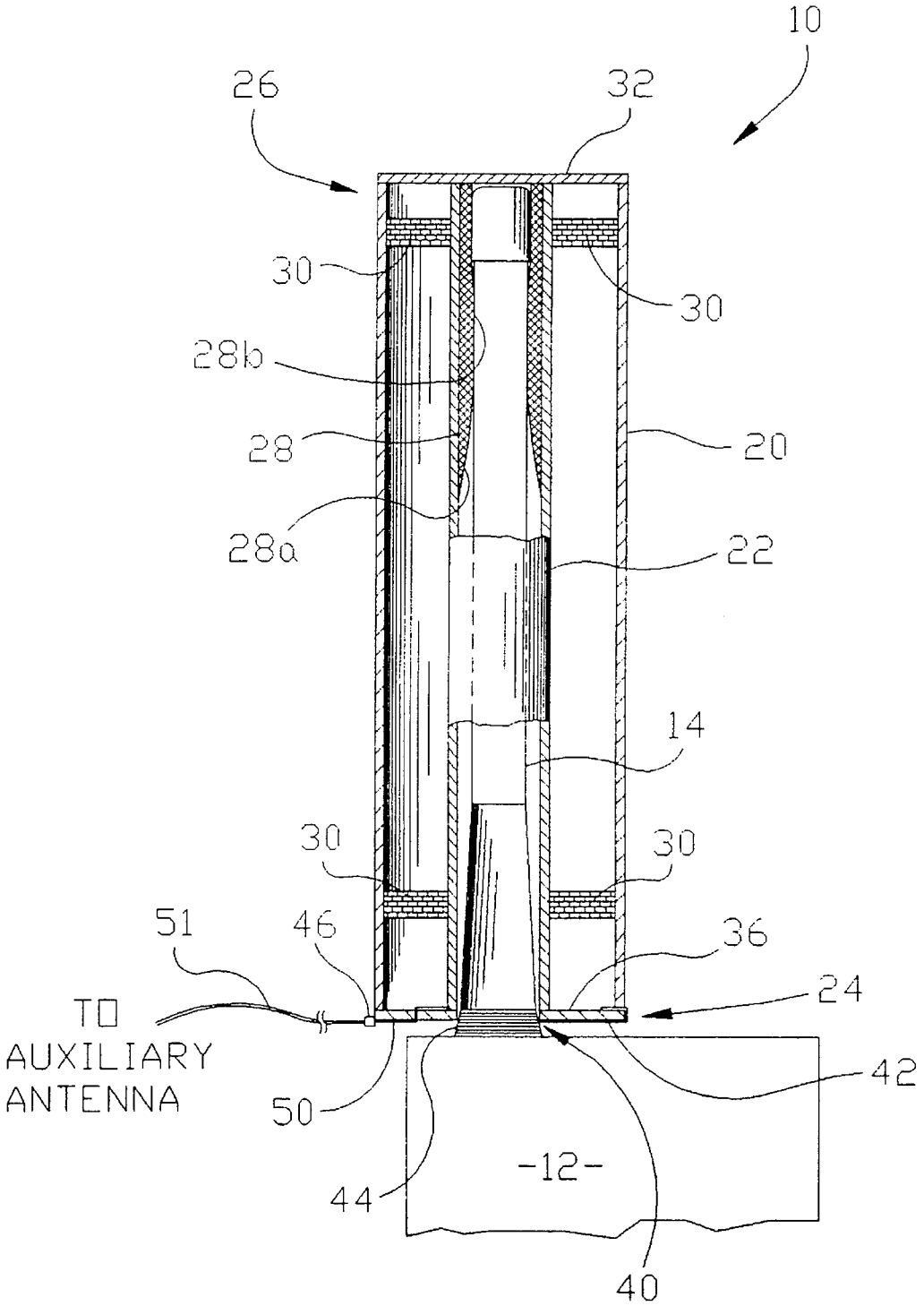
FIG. 2 is a sectional view of the antenna coupler of the present invention with the on-board antenna of a portable radio coupled with the antenna coupler.

Referring to FIGS. 1 and 2, antenna coupler 10 generally includes an outer tubular conductor 20 and an inner tubular conductor 22 coaxially disposed within the outer tubular conductor 20. Tubular conductors 20, 22 are made from or are plated with a conductive material such as copper and have an elongated cylindrical shape. The tubular conductors 20, 22 are coextensive and extend from an insertion end 24 to a remote end 26. The length between insertion end 24 and remote end 26 is selected to accommodate on-board antenna 14, as shown in FIGS. 1 and 2, and any other on-board antenna having a length less than the lengths of tubular conductors 20, 22. Accordingly, the length of tubular conductors 20, 22 varies according to the length of the longest on-board antenna intended to be coupled with the antenna coupler 10. In the preferred embodiment, the tubular conductors 20, 22 have a length ranging from approximately 5 inches to 7 inches.

The inner tubular conductor 22 has an internal diameter sized for accommodating an on-board antenna 14 inserted into the inner tubular conductor 22. In the preferred embodiment, the internal diameter of the inner tubular conductor 22 is approximately ½ inch. Mounted to the internal walls of the inner tubular conductor 22 towards the remote end 26 is an antenna guide 28 having an elongated, cylindrical shape.

Antenna guide 28 has a tapering inner wall section 28*a* and a main inner wall section 28*b*. An opening extends longitudinally through wall sections 28*a*, 28*b* of antenna guide 28. As shown in FIG. 2, the diameter of the opening of the antenna guide 28 at the main inner wall section 28*b* is sized to correspond with the diameter of the remote end of antenna 14 such that a close fit is formed between the main section 28*a* and an inserted, on-board antenna 14. During insertion of antenna 14 into the inner tubular conductor 22, the tapering inner wall section 28*a* functions to direct the antenna 14 into the main inner wall section 28*b* so that the inserted antenna 14 becomes generally aligned with the longitudinal axis of the inner tubular conductor 22.

The outer tubular conductor 20 has an internal diameter which is larger than the external diameter of the inner tubular conductor 22, resulting in the outer and inner tubular conductors 20, 22 being spaced apart. In the preferred embodiment, the internal diameter of the outer tubular conductor 20 is approximately 1½ inches. The thickness of the walls of the outer and inner tubular conductors 20, 22 is approximately 1/16 inch.

Supporting insulators 30 extend between the outer and inner tubular conductors 20, 22 to secure the tubular conductors 20, 22 together in their spaced-apart position. The supporting insulators 30 form rings around the inner tubular conductor 22 and are mounted on the opposing walls of the tubular conductors 20, 22. The supporting insulators 30 are made from a dielectric material, such as plastic, to prevent a conductive path from being formed between the outer and inner tubular conductors 20, 22.

Figure 3A:
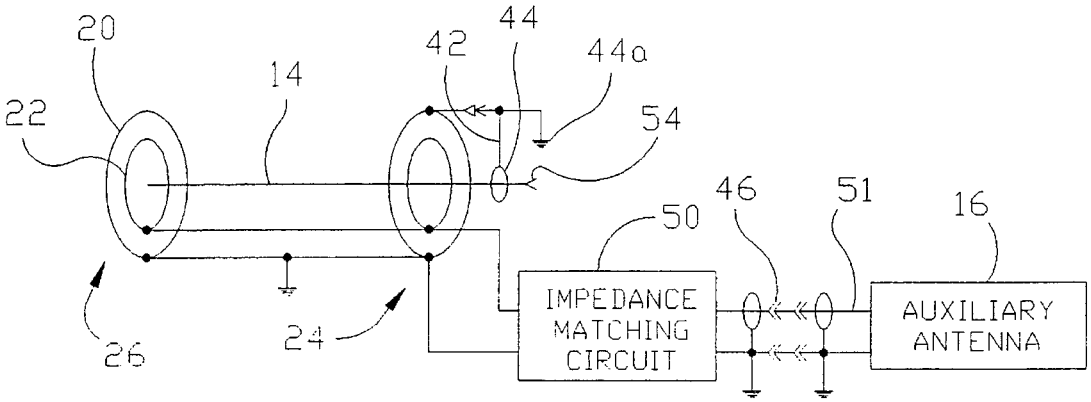
FIGS. 3*a* and 3*b* are schematics of alternative embodiments of the antenna coupler of the present invention, shown coupled with the on-board antenna.
Figure 3B:
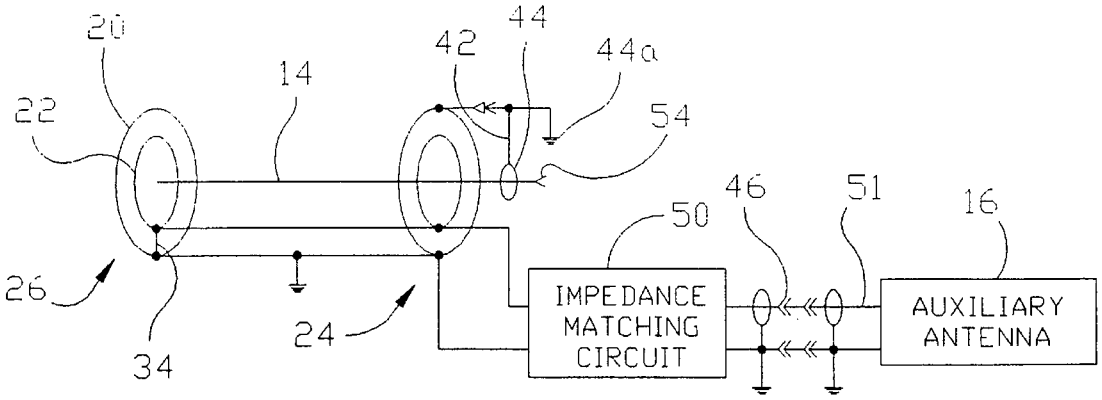
Figure 4A:
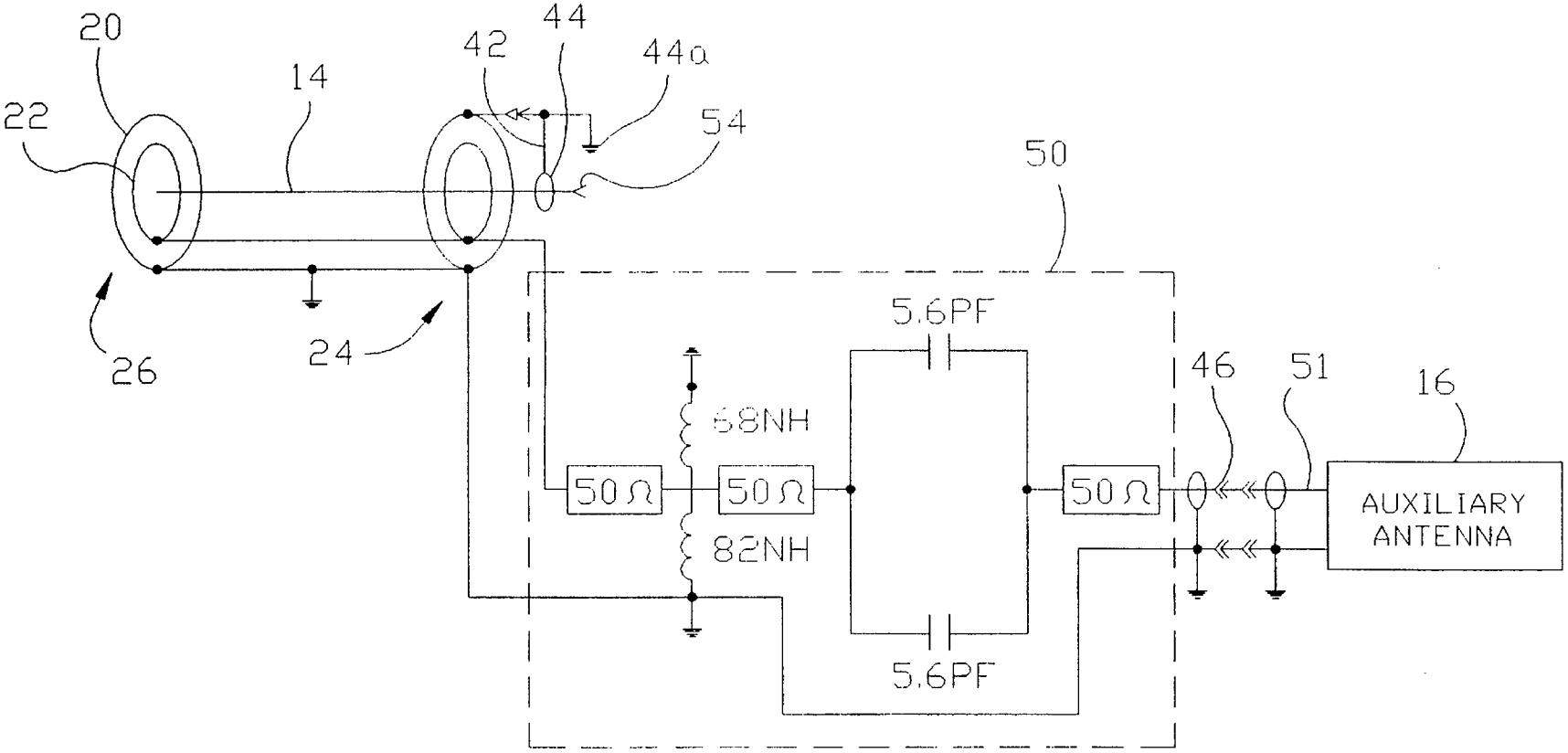
FIGS. 4*a–e* are schematics of antenna couplers of the present invention with matching circuits selected for different radio frequency ranges and types of antennas.
Figure 4B:
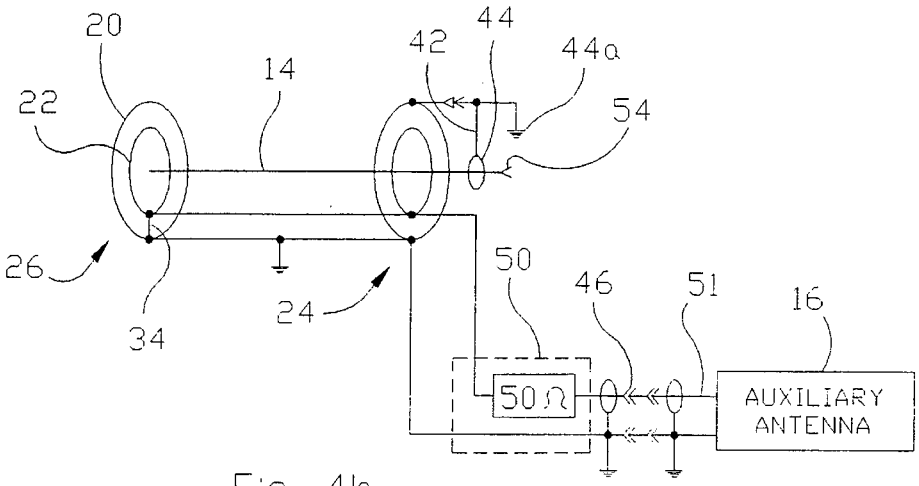
Figure 4C:
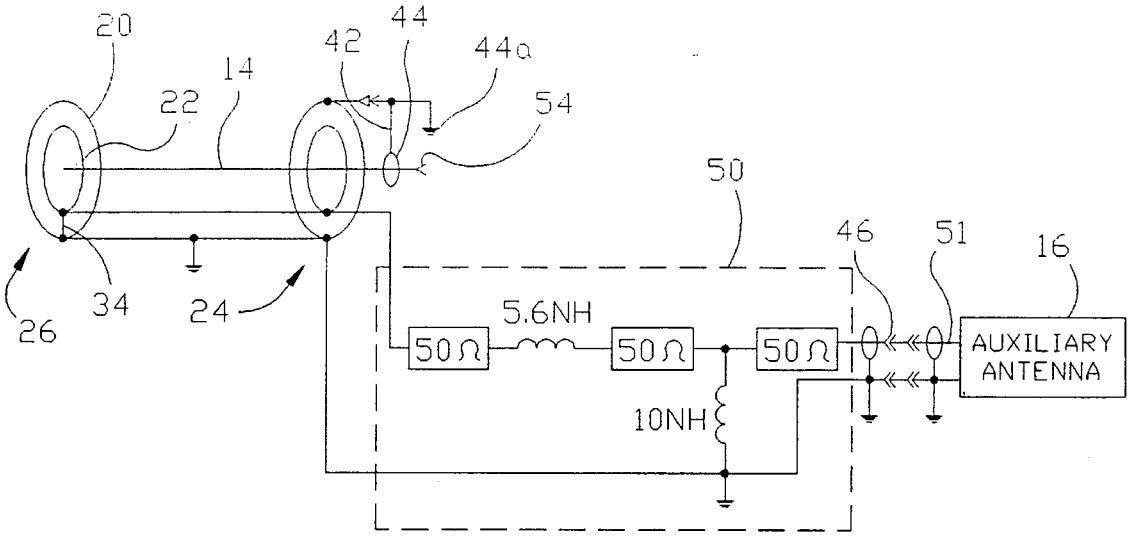
Figure 4D:
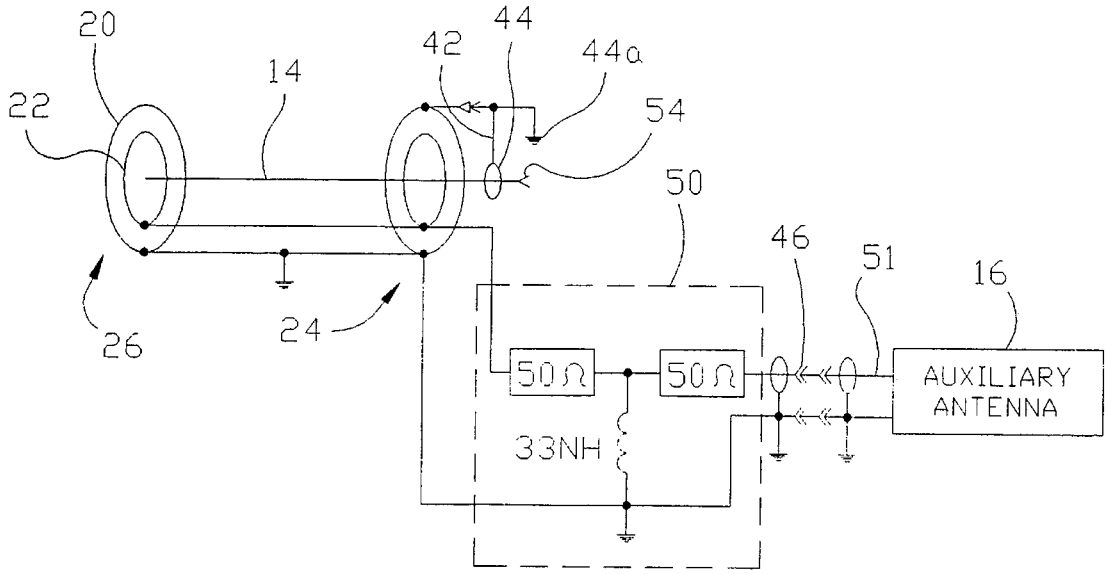
Figure 4E:
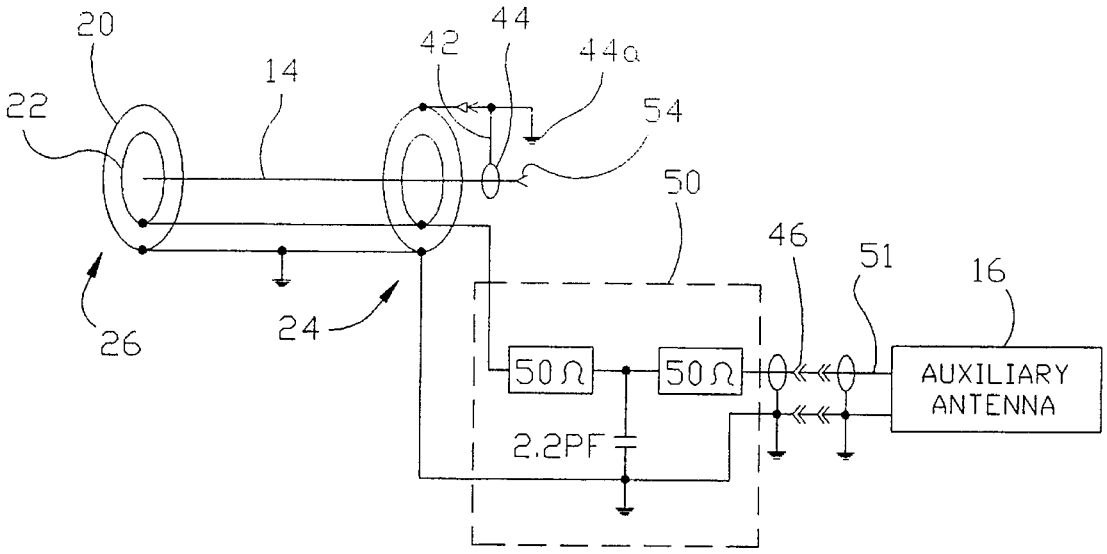

The remote end 26 of the tubular conductors 20, 22 is enclosed by an end cover 32. End cover 32 in one embodiment is made from a dielectric material and is secured to the tubular conductors 20, 22. When end cover 32 is formed from a dielectric the tubular conductors 20, 22 are electrically isolated at remote end 26, as shown in FIG. 3*a*. In an alternative embodiment of the present invention, end cover 32 is made from a conductive material. The conductive end cover 32 functions as a remote end conductor, and a conductive path is formed between the outer and inner tubes 20, 22 at the remote end 26, as shown in Figure 3*b*. Alternative embodiments of antenna coupler 10 can be provided where there is no end cover 32, and a remote end conductor is instead formed by extending a conductor between the outer and inner tubular conductors 20, 22 at the remote end 26. For example, an insulator support 30 located at remote end 26 could be modified to form a conductive path between the tubular conductors 20, 22.

Figure 2A:
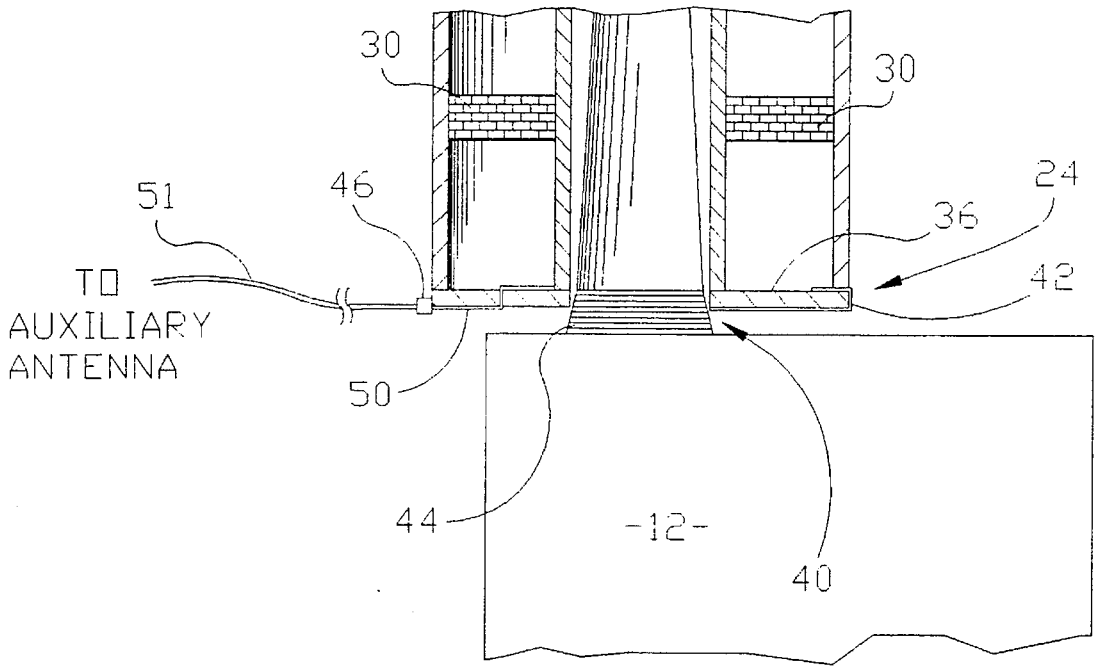
FIG. 2*a* is a sectional view of the insertion end of the antenna coupler with the on-board antenna of a portable radio coupled with the antenna coupler.

As best shown in FIG. 2*a*, secured to the insertion end 24 of the tubular conductors 20, 22 is an end cover 36 made from a dielectric material. For example, the end cover can be made from a printed circuit board. The end cover 36 has an antenna opening 40 for allowing insertion of the on-board antenna 14 into the inner tubular conductor 22. The antenna opening 40 of end cover 36 has a diameter approximately equal to the internal diameter of the inner tubular conductor 22 to allow insertion of the on-board antenna into the inner tubular conductor 22.

The end cover 36 includes a ground connector 42 for providing an electrical connection between the ground of portable radio 12 and the outer tubular conductor 20. In the preferred embodiment, the ground connector 42 is designed physically to contact a ground collar 44 formed at the base of the antenna 14 of portable radio 12. To form the desired conductive path, the ground connector 42 extends from the opening 40 along the bottom and along the outer edge of end cover 36 to mate physically with the outer tubular conductor 20.

The opening 40 of the end cover 36 has a diameter sized so that the ground collar 44 abuts against the bottom edge of opening 40 when the antenna 14 is fully inserted into the inner tubular conductor 22, as shown in FIG. 2*a*. This results inn ground connector 42 mating with the ground collar 44 and inner tubular conductor 22 remaining electrically isolated from both the outer tubular conductor 20 and ground collar 44. The ground connector 42 can also be designed to mate with radios having other types of external or internal grounds.

An RF connector 46 and impedance matching circuit 50 allow the inner tubular conductor 22 to be conductively connected to auxiliary antenna 16. RF connector 46 is externally mounted to end cover 36, and in the preferred embodiment is a coaxial connector impedance matching circuit 50 can include transmission lines and discrete components, as shown in FIGS. *4a–e*, and form a conductive path between RF connector 46 and inner tubular conductor 22. In the preferred embodiment of the impedance matching circuit 50, the transmission lines are microstrips and the discrete components can include inductors and capacitors. The impedance matching circuit 50 extends from RF connector 46, along the bottom of end cover 36, through an opening extending through end cover 36, and connects with the inner tubular conductor 22. Impedance matching circuit 50 provides impedance matching between antenna coupler 10 and auxiliary antenna 16. Impedance matching circuit 50 is secured to the end cover 36 and can easily be altered to provide effective impedance matching for different portable radios 12 operating in different frequency ranges.

An interconnecting transmission line 51 extends from the RF connector 46 to auxiliary antenna 16 so that the auxiliary antenna 16 is conductively connected to inner tubular conductor 22. In the preferred embodiment, the interconnecting transmission line 51 is a coaxial cable that mates with RF connector 46. As shown in FIG. 2, the RF connector 46 is connected at the insertion end 24 of antenna coupler 10. Likewise, the outer tubular conductor 20 and the inner tubular conductor 22 are connected to the ground collar 44 and auxiliary antenna 16, respectively, at the insertion end 24 of the antenna coupler 10. Providing these connections at the insertion end 24 helps limit the overall length of antenna coupler 10 and is a preferable design when antenna coupler 10 is to be used in a vehicle to couple a vehicular, auxiliary antenna 16 with a portable radio 12. Alternative embodiments of antenna coupler 10 can be provided where the outer and inner tubular conductors 20, 22 are connected to the ground collar 44 and auxiliary antenna 16, respectively, at the remote end 26 of the antenna coupler 10. Connections at the remote end 26 can be provided when the compactness of the antenna coupler 10 is not as critical, such as when the antenna coupler 10 is designed for test purposes.

FIGS. 3*a* and 3*b* show electrical schematics of embodiments of antenna coupler 10 conductively connected and electrically matched to a 50-ohm source/load, e.g., an auxiliary antenna 16. As shown in FIGS. 3*a* and 3*b*, when antenna 14 is coupled to the antenna coupler 10, the outer tubular conductor 20 is grounded because ground connector 42 connects ground collar 44 to outer tubular conductor 22. The ground collar 44 is connected to the radio ground 44*a* providing a common ground for portable radio 12 and outer tubular conductor 20. In addition, auxiliary antenna 16 is conductively connected to the inner tubular conductor 22 because auxiliary-antenna connector 46, impedance matching circuit 50, and transmission line 51 form a conductive path between the auxiliary antenna 16 and inner tubular conductor 22.

FIGS. 3*a* and 3*b* also schematically show on-board antenna 14 positioned in inner tubular conductor 22. When inserted into the inner tubular conductor 22, the on-board antenna 14 is aligned along the longitudinal axis of tubular conductors 20, 22 so that the inner tubular conductor 22 surrounds on-board antenna 14 with a space separating on-board antenna 14 and inner tubular conductor 22. This positioning results in on-board antenna 14 and inner tubular conductor 22 forming a dual-element transmission line with on-board antenna 14 functioning as the central conductor and inner tubular conductor 22 functioning as an outer conductor of the transmission line. The transmission line formed by antenna 14 and inner tubular conductor 22 couples portable radio 12 with auxiliary antenna 16, and allows portable radio 12 either to transmit or to receive signals via the auxiliary antenna 16.

Outer tubular conductor 20 surrounds antenna 14 and inner tubular conductor 22, and is grounded to ground collar 44 to provide a common ground for portable radio 12 and antenna coupler 10. The tubular conductors 20, 22 and antenna 14 function as a three conductor coaxial transmission line with the outer tubular conductor 20 being the outermost conductor and forming a reference ground for both on-board antenna 14 and inner tubular conductor 22. By surrounding antenna 14 and inner tubular conductor 22, outer tubular conductor 20 helps prevent RF energy generated by portable radio 12 from getting into equipment surrounding the antenna coupler 10. In addition, antenna 14 is shielded from unwanted signals generated from equipment surrounding the antenna coupler 10, resulting in improved signal reception by portable radio 12.

FIG. 3*a* shows an electrical schematic for an antenna coupler 10 having an end cover 32 that is a dielectric. FIG. 3*b* shows an electrical schematic for an antenna coupler 10 having a conductive end cover 32 for electrically connecting the outer and inner tubular conductors 20, 22 at the remote end 26 with remote end conductor 34. For the embodiment of antenna coupler 10 shown in FIG. 3*a*, the outer and inner tubular conductors 20, 22 remain electrically isolated along their entire length because the insulator supports 30 separating outer and inner tubular conductors 20, 22 do not conduct electricity and the end covers 32, 36 are made from dielectric material to prevent electrical connection. For the embodiment of antenna coupler 10 shown in FIG. 3*b*, the outer and inner tubular conductors 20, 22 are electrically connected at the remote end 26 by remote end conductor 34 and remain electrically isolated from one another along their remaining length.

For certain types of on-board antennas 14 operating in certain frequency ranges, performance of the antenna coupler 10 is improved by providing remote end conductor 34 at remote end 26. For example, a test antenna coupler 10 according to the present invention was tested using standard whip and helical antennas operating at different frequency ranges between the frequencies of 146–941 MHz. The whip and helical antennas used were from the M-PA product line of personal radios manufactured by Ericsson Inc. The antenna coupler 10 used in the test had an outer and inner tubular conductor 20, 22 with lengths of approximately 6 inches, and were constructed from copper "plumbing" pipe with the outer tubular conductor 20 having a 1½ inches nominal diameter and the inner tubular conductor having a ½ inch nominal diameter.

The test antenna coupler 10 was adjusted for different frequency ranges by altering the impedance matching circuit 50 to optimize the transmission coefficient through the antenna coupler 10 for a 50-ohm load. Schematics of the impedance matching circuits 50 used in the testing are shown in FIGS. *4a–e*. The impedance matching circuits 50 for the test antenna coupler 10 include 50 Ω microstrips, capacitors, and inductors arranged and having values as shown in FIGS. *4a–e*. Impedance matching circuits 50 are well known in the prior art and various different impedance matching circuits can be used for antenna coupler 10.

Test results showed antenna coupler 10 operated most effectively with outer and inner tubular conductors 20, 22 shorted together at remote end 26 by remote end conductor 34 for the 450–470 MHz frequency range. The test results for the test antenna coupler 10 showing transmission coefficient measurements are shown below:

TRANSMISSION COEFFICIENT MEASUREMENT TABLE

| Frequency Range | Operating Frequency | Transmission Coefficient (dB) |
|---|---|---|
| 146–162 MHz | 146 | −3.8 dB |
| (Helical Antenna) | 150 | −3.3 dB |
| | 162 | −4.1 dB |
| 450–470 MHz | 450 | −3.4 dB |
| (Helical Antenna) | 470 | −3.0 dB |
| 450–470 MHz | 450 | −0.7 dB |
| (Whip Antenna) | 470 | −0.7 dB |
| 806–870 MHz | 806 | −1.3 dB |
| (Whip Antenna) | 870 | −2.6 dB |
| 896–941 MHz | 896 | −1.0 dB |
| (Whip Antenna) | 941 | −1.2 dB |

In operation, the portable radio 12 is coupled to antenna coupler 14 by inserting the on-board antenna 14 into the antenna coupler 10, as shown in FIG. 2. To transmit an RF signal, portable radio 12 generates a signal that is passed through antenna port 54 and to antenna 14. The close coupling of on-board antenna 14 and inner tubular conductor 22 causes the signal on on-board antenna 14 to be coupled to the inner tubular conductor 22. This coupled signal on the inner tubular conductor 22 is then passed to the impedance matching circuit 50 and to coaxial transmission line 51, via the auxiliary-antenna connector 46. The auxiliary antenna 16 then radiates the RF signal originating at the portable radio 12. Portable radio 12 also receives RF signals via the auxiliary antenna 16. RF signals received at auxiliary antenna 16 are passed to the inner tubular conductor 22 through coaxial transmission line 51, auxiliary-antenna connector 46, and impedance matching circuit 50. The RF signal is then coupled to the on-board antenna 14 and passed to portable radio 12.

Antenna coupler 10 allows portable radio 12 both to transmit and to receive RF signals via the auxiliary antenna 16. Antenna coupler 10 is designed to be operational with a variety of different on-board antennas 14 including whip and helical antennas. Likewise, antenna coupler 10 is operational with on-board antennas 14 having different lengths and operating over different frequency ranges. Different impedance matching circuits 50 can easily be provided for a particular antenna coupler 10 depending on the length of the on-board antenna 14 and operational frequency range of the portable radio 12.

It will be appreciated by those of ordinary skill in the art that the present invention can be embodied in other specific forms without departing from the spirit or essential character thereof. The presently disclosed embodiments are, therefore, considered in all respects to be illustrative and not restrictive.

What is claimed is:

1. An antenna coupler for coupling an on-board antenna of a portable radio to an RF device, comprising:

a. an outer tubular conductor having an insertion end and a remote end;

b. an inner tubular conductor disposed within the outer tubular conductor with the inner and outer tubular conductors spaced from one another, the inner tubular conductor having an insertion end and a remote end, wherein the inner tubular conductor is sized to receive the on-board antenna so as to position the on-board antenna and antenna coupler in a coupled position, and wherein said inner tubular conductor and said outer tubular conductor are substantially coextensive at said insertion ends;

c. a ground connector conductively connected to the outer tubular conductor, the ground connector conductively connecting with a radio ground so as to ground the outer tubular conductor when the antenna coupler and on-board antenna are in the coupled position;

d. an RF connector conductively connected to the inner tubular conductor for coupling with an interconnecting transmission line leading to the RF device; and e. an impedance matching circuit conductively connected between the RF connector and the inner tubular conductor for providing impedance matching between the antenna coupler and the RF device; and f. wherein when in the coupled position the on-board antenna is coupled with the antenna coupler and the portable radio transmits and receives RF energy to or from the RF device; and g. wherein when in the coupled position, said on-board antenna, said inner tubular conductor, and said outer tubular conductor form a transmission line extending from said insertion ends along the length of said on board antenna.

2. The antenna coupler of claim 1, wherein the ground connector is conductively connected to the outer tubular conductor at the insertion end.

3. The antenna coupler of claim 1, wherein the impedance matching circuit is conductively connected to the inner tubular conductor at the insertion end.

4. The antenna coupler of claim 3, wherein the RF connector is mounted at the insertion end of the tubular conductors.

5. The antenna coupler of claim 3, further including a remote end conductor for conductively connecting the outer and inner tubular conductors at the remote end so as to ground the inner tubular conductor at the remote end when the on-board antenna is in the coupled position.

6. The antenna coupler of claim 1 further including an end conductor disposed at one end of the tubular conductors for conductively connecting the inner and outer tubular conductors, and the impedance matching circuit conductively connected to the inner tubular conductor at an opposite end of the tubular conductors.

7. The antenna coupler of claim 1, further including an end cover attached to the insertion end of the tubular conductors, the end cover having an antenna opening sized for insertion of the on-board antenna through the antenna opening and into the inner tubular conductor, and wherein the ground connector and impedance matching circuit are mounted to the end cover.

8. The antenna of claim 7, wherein the antenna opening of the end cover has a diameter sized to correspond with an antenna ground collar, and wherein the ground conductor conductively connects with the antenna ground collar when the on-board antenna is inserted into the inner tubular conductor.

9. The antenna coupler of claim 1, further including insulator supports made from a dielectric for maintaining the inner and outer tubular conductors in a spaced-apart position.

10. The antenna coupler of claim 1, further including an antenna guide mounted on an inner wall of the inner tubular conductor for coaxially aligning the portable antenna in the inner tubular conductor.

11. The antenna coupler of claim 10, wherein the antenna guide has an elongated, cylindrical shape and is disposed at the remote end of the inner tubular conductor, the antenna guide including a tapering inner wall section disposed towards the insertion end of the inner tubular conductor and a main inner wall section disposed towards the remote end of the inner tubular conductor, wherein the tapering inner wall section guides the portable antenna into the main inner wall section as the on-board antenna is inserted into the inner tubular conductor and the main inner wall section coaxially aligns the portable antenna within the inner tubular conductor.

12. The antenna coupler of claim 1, further comprising:

a. an impedance matching circuit conductively connected between the RF connector and the inner tubular conductor for providing impedance matching between the antenna coupler and the RF device; and b. an end cover mounted at the insertion end of said inner and outer tubular conductors; and c. a remote end conductor for conductively connecting the outer and inner tubular conductors at the remote end so as to ground the inner tubular conductor at the remote end when the on-board antenna is in the coupled position;

d. wherein the impedance matching circuit is selected to provide impedance matching for operation of the portable radio at a predetermined frequency range, and wherein the impedance matching circuit is alterable to provide different impedance matching circuits for portable radios operating at different predetermined frequency ranges so as to provide for the coupling of portable radios operating at different frequency ranges, and wherein the impedance matching circuit is mounted on said end cover.

13. The antenna coupler of claim 12, further comprising:

an antenna guide mounted on an inner wall of the inner tubular conductor for coaxially aligning the portable antenna in the inner tubular conductor;

wherein the antenna guide has an elongated, cylindrical shape and is disposed at the remote end of the inner tubular conductor, the antenna guide including a tapering inner wall section disposed towards the insertion end of the inner tubular conductor and a main inner wall section disposed towards the remote end of the inner tubular conductor, wherein the tapering inner wall section guides the portable antenna into the main inner wall section as the on-board antenna is inserted into the inner tubular conductor and the main inner wall section coaxially aligns the portable antenna within the inner tubular conductor.

14. The antenna coupler of claim 1, further comprising an RF connector conductively connected to the insertion end of the inner tubular conductor, wherein said inner tubular conductor is substantially as long as said outer tubular conductor and at least as long as said on board antenna, and wherein said inner conductor, said outer conductor and said on-board antenna form an uninterrupted transmission line along length of said on-board antenna.

15. The antenna coupler of claim 1, wherein said inner tubular conductor and said outer tubular conductor are substantially coextensive at said remote ends so as to form a transmission line along substantially the entire length of said inner and outer tubular conductors.

16. The antenna coupler of claim 1, wherein said RF connector is connected to the insertion end of said inner tubular conductor.

17. An antenna coupler for coupling an on-board antenna of a portable radio to an RF device, comprising:

a. an outer tubular conductor having an insertion end and a remote end;

b. an inner tubular conductor disposed within the outer tubular conductor with the inner and outer tubular conductors spaced from one another, the inner tubular conductor having an insertion end and a remote end, and the inner tubular conductor sized to receive the on-board antenna so as to position the on-board antenna and antenna coupler in a coupled position;

c. a ground connector conductively connected to the outer tubular conductor, the ground connector conductively connecting with a radio ground so as to ground the outer tubular conductor when the antenna coupler and on-board antenna are in the coupled position;

d. an RF connector conductively connected to the insertion end of the inner tubular conductor for coupling with an interconnecting transmission line leading to the RF device;

e. an impedance matching circuit conductively connected between the RF connector and the inner tubular conductor for providing impedance matching between the antenna coupler and the RF device;

f. a remote end conductor for conductively connecting the outer and inner tubular conductors at the remote end so as to ground the inner tubular conductor at the remote end when the on-board antenna is in the coupled position;

g. wherein when in the coupled position the on-board antenna is coupled with the antenna coupler and the portable radio transmits and receives RF energy to or from the RF device.

18. The antenna coupler of claim 17, wherein the remote end conductor is an end cover attached at the remote end of the tubular conductors and including a conductive path conductively connecting the inner and outer tubular conductors at the remote end.

19. An antenna coupler for coupling an on-board antenna of a portable radio to an RF device, comprising:

a. an outer tubular conductor having an insertion end and a remote end;

b. an inner tubular conductor disposed within the outer tubular conductor with the inner and outer tubular conductors spaced from one another and having an insertion end and a remote end, the inner tubular conductor sized to receive the on-board antenna so as to position the on-board antenna and antenna coupler in a coupled position;

c. a ground connector conductively connected to the outer tubular conductor, the ground connector conductively connecting with a radio ground so as to ground the outer tubular conductor when the antenna coupler and on-board antenna are in the coupled position;

d. an end cover mounted at the insertion end of said inner and outer tubular conductors; and e. an impedance matching circuit mounted on said end cover and conductively connected between on RF connector and the inner tubular conductor for providing impedance matching between the antenna coupler and the RF device;

f. wherein when in the coupled position the on-board antenna is coupled with the antenna coupler and the portable radio transmits and receives RF energy to or from the RF device; and g. wherein the impedance matching circuit is selected to provide impedance matching for operation of the portable radio at a predetermined frequency range, and wherein the impedance matching circuit is alterable to provide different impedance matching circuits for portable radios operating at different predetermined frequency ranges so as to provide for the coupling of portable radios operating at different frequency ranges.

20. An antenna coupler for coupling an on-board antenna of a portable radio to an RF device, comprising:

a. an outer tubular conductor having an insertion end and a remote end;

b. an inner tubular conductor disposed within the outer tubular conductor with the inner and outer tubular conductors spaced from one another, the inner tubular conductor having an insertion end and a remote end, and the inner tubular conductor sized to receive the on-board antenna so as to position the on-board antenna and antenna coupler in a coupled position, said inner tubular conductor being substantially as long as said outer tubular conductor and at least as long as said on-board antenna;

c. an impedance matching circuit conductively connected to the inner tubular conductor and coupleable to the RF device for providing a conductive path between the antenna coupler and the RF device, and wherein the impedance matching circuit provides impedance matching for operation of the portable radio at a predetermined frequency range, and wherein the impedance matching circuit is alterable to provide different impedance matching circuits for portable radios operating at different predetermined frequency ranges so as to provide for the coupling of portable radios operating at different frequency ranges;

d. wherein when in the coupled position the on-board antenna is coupled with the antenna coupler and the portable radio transmits and receives RF energy to or from the RE device; and e. wherein when in the coupled position, said on-board antenna, said inner tubular conductor, and said outer tubular conductor form a transmission line extending from said insertion ends along the length of said on-board antenna.

21. The antenna coupler of claim 20, further including a ground connector conductively connected to the outer tubular conductor so as to ground the outer tubular conductor and provide a reference ground for the on-board antenna and inner tubular conductor when in the coupled position.

22. The antenna coupler of claim 20, further including an RF connector conductively connected to the impedance matching circuit for coupling the impedance matching circuit to the interconnecting transmission line leading to the RF device.

23. The antenna coupler of claim 20 further including an end conductor conductively connected between the outer and inner tubular conductors at one end of the tubular conductors when the coupled portable radio is operating at a predetermined frequency range.

* * * * *